United States Patent [19]

Fotre et al.

[11] 3,995,331

[45] Dec. 7, 1976

[54] INFANT BATH AND LOUNGE SEAT

[76] Inventors: Sandra H. Fotre, 2351 Siena Court; Donna I. Boeckman, 2326 N. Indian Hill Blvd., both of Claremont, Calif. 91711

[22] Filed: Feb. 2, 1976

[21] Appl. No.: 654,296

[52] U.S. Cl. ..... 4/185 B

[51] Int. Cl.[2] ..... A47K 3/064; A47K 3/03

[58] Field of Search ..... 4/185 R, 185 B, 185 AB, 4/185 S, 185 L, 254, 159

[56] References Cited

UNITED STATES PATENTS

| | | | |
|---|---|---|---|
| 1,062,704 | 5/1913 | Greenwood | 4/185 B |
| 1,758,071 | 5/1930 | Blaustein | 4/185 B |
| 2,112,409 | 3/1938 | Prince | 4/185 B |
| 2,285,900 | 6/1942 | Chapman | 4/185 B |
| 2,460,308 | 2/1949 | Pribil | 4/185 B |
| 2,495,482 | 1/1950 | Rogatz | 4/185 B |
| 2,503,938 | 4/1950 | Davis, Jr. | 4/185 B |
| 2,957,184 | 10/1960 | Smith | 4/185 B |
| 3,072,923 | 1/1963 | Zuke | 4/185 B |
| 3,162,864 | 12/1964 | Ouellette | 4/185 B |
| 3,545,016 | 12/1970 | Schorken | 4/185 B |

*Primary Examiner*—Henry K. Artis
*Attorney, Agent, or Firm*—Boniard I. Brown

[57] ABSTRACT

An infant care accessory having a pair of shell-like sections pivotally joined to one another in generally clam-shell fashion for relative rotation between unfolded positions wherein the sections are disposed end to end to form an infant bathing and lounging seat or cradle and folded positions wherein the sections are disposed in confronting contacting relation to form a carrier for infant care articles and the like. The accessory is equipped with means for supporting the accessory in its unfolded cradle configuration on a supporting surface and a handle for holding the accessory in its folded carrier configuration. The hinged sections of the structure have water drain holes for bath water. The accessory may be shaped to simulate a turtle in its carrier configuration.

10 Claims, 5 Drawing Figures

INFANT BATH AND LOUNGE SEAT

BACKGROUND OF THE INVENTION

1. Field of the Invention

This invention relates generally to infant care accessories and more particularly to such an accessory which may be used as an infant bathing and lounging seat or cradle and as a carrier for infant care articles and the like.

2. Discussion of the Prior Art

The prior art is replete with a vast assortment of infant care accessories, such as bathing and lounging seats or cradles and carriers for infant care articles and the like. The prior art also contains an assortment of multiple purpose structures which may be used as both a seat and an article carrier. Examples of such accessories and structures are found in U.S. Pat. Nos. 3,092,224, 3,422,938, and 3,545,016. There is a need, however, for a multiple purpose infant care accessory which may be used both as an infant bathing and lounging seat or cradle for infant care articles and the like. This invention provides such a multiple purpose infant care accessory.

SUMMARY OF THE INVENTION

The multiple purpose infant care accessory of the invention has a pair of shell-like sections each including a main support wall bounded along two sides and one end by an upstanding edge wall. These sections are pivotally joined along their remaining open ends for relative rotation of the sections between unfolded and folded positions. In their unfolded positions, the sections are disposed end to end with their support walls lowermost and their edge walls rising above the support walls to form a bathing and lounging seat or cradle. Means are provided on the sections for supporting the accessory on a supporting surface, such as the bottom of a bath tube for the purpose of holding an infant during bathing or a table or seat for the purpose of holding the infant for drying and other care after bathing or simply lounging or sleeping.

In their folded positions, the hinge sections of the accessory are disposed in confronting relation with their support walls face to face and their edge walls extending toward and contacting one another to form an article carrier for infant care articles or the like. Means are provided for releasiblty securing the sections to one another in this carrier configuration, and a handle is provided for holding the carrier. In the particular invention embodiment disclosed, this handle constitutes one element of the support means for supporting the accessory in its cradle configuration.

According to a feature of the invention, the section support walls are aperture to provide drain holes through which water may drain when removing the accessory from bath water. A cushioned pad may be provided for placement of the accessory in its cradle configuration. The described accessory also has straps for securing an infant in the accessory. The accessory may be shaped to simulate a turtle in its carrier configuration.

DESCRIPTION OF THE PREFERRED EMBODIMENT

Figures 1, 2, 3, 4, 5:
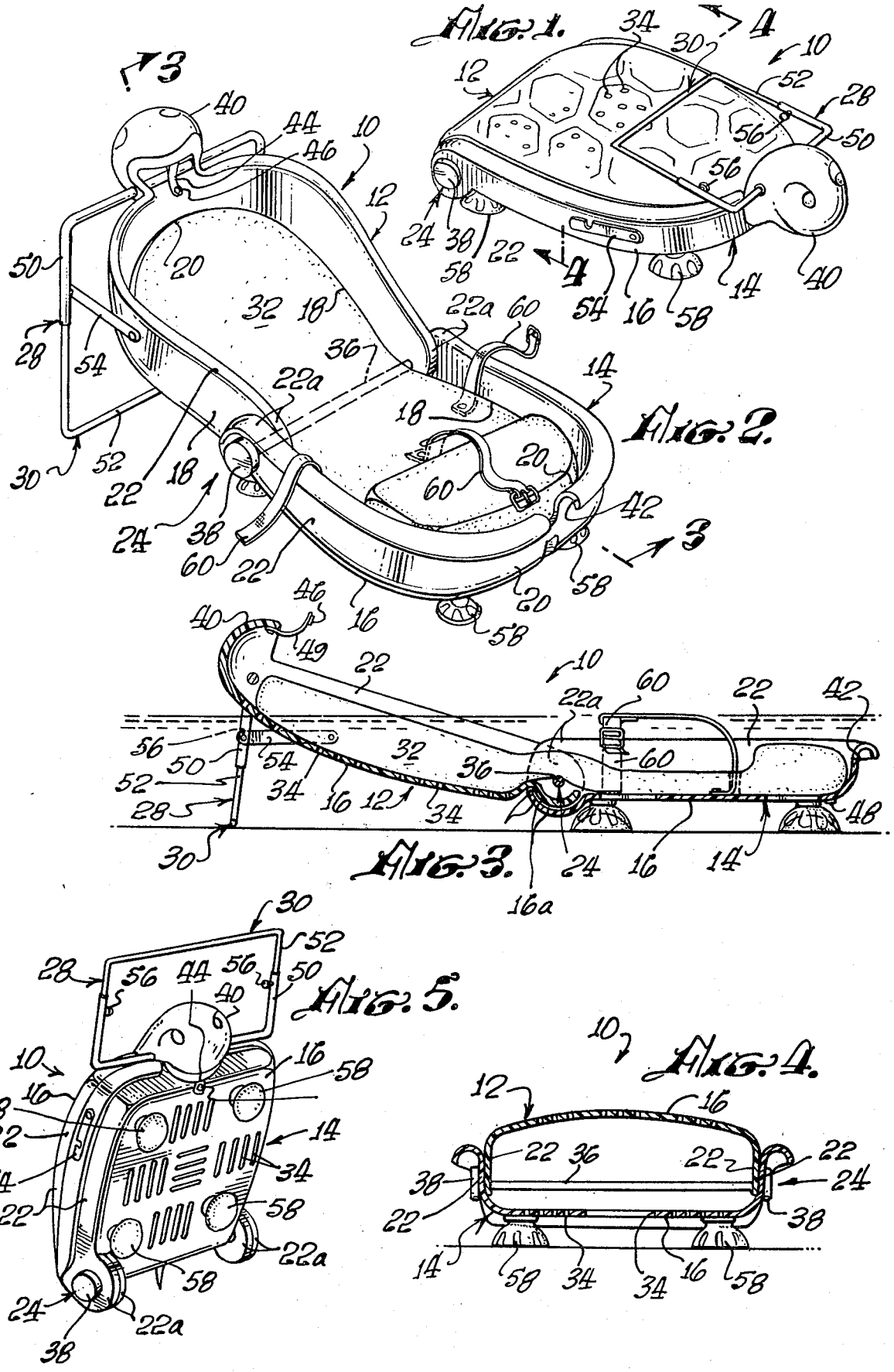
FIG. 1 is a perspective view of an infant care accessory according to the invention in its folded article carrier configuration.
FIG. 2 is an enlarged perspective view of the accessory in its unfolded cradle configuration.
FIG. 3 is a section taken on line 3—3 in FIG. 2.
FIG. 4 is a section taken on line 4—4 in FIG. 1.
FIG. 5 is a perspective view of the accessory in folded carrying position.

The infant care accessory 10 illustrates comprises a pair of hinged, shell-like sections 12, 14 which may be injection molded from a suitable plastic material. Each section 12, 14 has a main support wall 16 with side and end edges 18, 20 and an upstanding edge wall 22 along the side edges and one end edge. The opposite end of each section is devoid of an edge wall and for convenience is referred to herein as the open end of the section. Sections 12, 14 are disposed with their open ends adjacent one another and pivotally joined by hinge means 24 for relative rotation of the sections between their folded positions of FIG. 1 and their unfolded positions of FIG. 2.

In their folded positions of FIG. 1, the two accessory sections 12, 14 are disposed in confronting relation with their support walls 16 facing one another and their edge walls 22 projecting toward and contacting one another to form an article carrier or carrying case for infant care articles or the like. In their unfolded positions of FIG. 2, the sections 12, 14 are disposed end to end with the support walls 16 lowermost and their edge walls 22 projecting upwardly above the support walls to form an infant bathing and lounging seat, or cradle as it is referred to herein.

Means 26 are provided for releasibly securing the sections 12, 14 in their folded carrier configuration of FIG. 1. A handle 28 is provided for holding the carrier. This handle also forms one element of supporting means 30 for supporting the accessory 10 on a supporting surface, such as the bottom of a bath tub, or table, or a seat, in the unfolded cradle configuration of the accessory shown in FIG. 2 A cushion or pad 32 may be placed in the accessory in its cradle configuration to provide a soft support for an infant's body. The support walls 16 of the sections 12, 14 are apertured to provide drain holes 34 through which water may drain from the accessory when the latter is removed from bath water.

Referring in more detail to the particular infant care accessory 10 shown, the width and length dimensions of its section 12 are somewhat smaller than the corresponding dimensions, of section 14, and the sections are disposed in interfitting relation, as shown. Thus, referring to FIGS. 2 and 3, it will be seen that the open end of section 12 fits within and in overlapping relation to the open end of section 14, such that the support walls 16 of the sections have overlapping portions **16*a* and their edge walls 22 have overlapping portions 22*a*. The hinge means 24 for the sections comprises a pivot shaft 36 extending through the overlapping edge wall portions 22*a* and having enlarged heads or shoulders 38 at its ends. The overlappng support wall portions 16*a* are cylindrically curved about the axis of the pivot shaft and disposed in interfitting relation, and the ends of the edge walls 22 are circularly curved about the shaft axis, all as shown best in FIG. 3, whereby the sections can hinge or rotate between their folded and unfolded positions. In the folded positions the sections shown in FIGS. 1 and 4, section 12 fits within section 14 with the edge walls 22 of the sections laterally overlapping one another, as shown best in FIG. 4.**

Section 12 has longitudinally projecting portion 40 at its closed or outer end. This portion projects from the center of the section edge wall 22 and beyond the outer side of the wall. The edge wall 22 of section 14 is notched at 42 at the outer closed end of the latter section to receive the projecting portion 40 when the sections are folded to their carrier configuration of FIGS. 1 and 5. Securing means 26 comprises a strap 44 fixed to the projection portion and having a snap fastener part 46 for engagement with a mating fastener part 48 on the section 14 when the sections are folded.

Handle 28 comprises a generally rectangular bail having telescopically adjustable sections 50, 52. Section 52 is pivotally attached to the projecting portion 40 of accessory section 12. In the tote or carrying position of the accessory, the handle is disposed, as shown in FIG. 5. The adjustable handle sections are retained against separation in any convenient way and are adjustable for the reasons explained below.

As noted above, handle 28 also provides a portion of the supporting means 30 for supporting the accessory in its cradle configuration of FIGS. 2 and 3 on a supporting surface. Thus, as shown in these latter figures, the handle is rotatable to a support position wherein the handle projects below the section 12 in its unfolded position to rest on the supporting surface. The handle is releasibly secured in this position by hinged hook arms 54 which are pivotally secured to the edge wall 22 of of section 12 to engage over studs 56 on the handle to lock the handle in fixed position relative to the section 12. The then lower handle section 52 is vertically adjustable relative to the upper handle section 50 to raise and lower the section 12. The accessory supporting means 30 also includes suction cups 58 attached to the outer or lower side of the support wall 16 of accessory section 14. The accessory may be provided with body straps 60 for securing an infant in the accessory in its unfolded cradle configuration.

When the accessory is used as an article carrier for infant care articles or the like, its sections 12, 14 are folded, as in FIGS. 1, 4 and 5 and secured to one another by the strap 26. When used as an infant bathing or lounging cradle, the sections are unfolded to their positions of FIGS. 2 and 3 and the handle 28 is fixed in its support position. The pad 32 is removed for bathing and placed in the accessory for lounging.

As shown, the accessory may be shaped to simulate a turtle in its folded carrier configuration.

The inventors claim:

1. An infant care accessory for use as an infant bathing and lounging cradle and an article carrier, comprising:

a pair of hinged shell-like sections each including a main support wall having side and end edges, and an edge wall along said side edges and one end projecting beyond one side of said support wall, whereby each section has an open end along its opposite end edge, said sections being disposed with their open ends adjacent one another, hinge means pivotally joining the adjacent ends of said sections for relative rotation of said sections between unfolded positions wherein said sections are disposed in generally end to end relation with their support walls lowermost and their edge walls projecting upwardly above the support walls to form an infant bathing and lounging cradle, and folded positions wherein said sections are disposed in confronting relation with their support walls facing one another and their edge walls projecting toward and into close proximity to one another to form an article carrier, means for releasibly securing said sections to one another in their positions to retain said accessory in its carrier configuration, means for supporting said accessory in its unfolded cradle configuration, and handle means attached to said accessory for holding the accessory in its folded carrier configuration.

2. An infant care accessory according to claim 1 wherein:

said support walls of each section has water drain holes.

3. An infant care accessory according to claim 1 wherein:

said sections are disposed in interfitting relation in a manner such that in said unfolded positions, the open end of one section fits within the open end of the other section, whereby said section support and end walls have end portions at the open section ends which longitudinally overlap one another in said cradle configuration of said accessory, and in said folded positions said one section fits within said other section with said edge walls overlapping one another in their lateral directions, and said hinge means pivotally joins said overlapping edge wall portions.

4. An infant care accessory according to claim 3 wherein:

said overlapping support wall portions are cylindrically curved about the hinge axis of said sections and disposed in interfitting relation in a manner such that said latter wall portions overlap one another throughout the range of relative rotation of said sections between their folded and unfolded positions.

5. An infant care accessory according to claim 1 wherein:

said handle means comprises a bail-like pivotally attached to said one end of one section to swing between a carrying position wherein said handle is generally coplanar with said sections in the folded carrier configuration of said accessory, and an accessory support position wherein said handle forms a part of said accessory supporting means and projects below said latter section for engagement with a supporting surface in said unfolded cradle configuration of said accessory, and said supporting means further comprising means for releasibly securing said handle in its support position.

6. An infant care accessory according to claim 5 wherein:

said handle is adjustable to vertically adjust said latter section

7. An infant care accessory according to claim 1 wherein:

said sections are disposed in interfitting relation in a manner such that in said unfolded positions, the open end of one section fits within the open end of the other section, whereby said section support and end walls have end portions at the end section ends which longitudinally overlap one another in said cradle configuration of said accessory, and in said folded positions said one section fits within said other section with said edge walls overlapping one another in their lateral directions, said hinge means pivotally joins said overlapping edge wall portions, said overlapping support wall portions are cylindrically curved about the hinge axis of said sections and disposed in interfitting relation in a manner such that said latter wall portions overlap one another throughout the range of relative rotation of said sections between their folded and unfolded positions, said one section has a projecting portion at said one end of the latter section which projects longitudinally of the latter section and beyond the outer side of its edge wall, said other section has a notch in its edge wall at said one end of the latter section for receiving said projecting portion when said sections are folded to their carrier configuration, and said handle means comprising a bail-like handle pivotally attached to said projecting portion, to swing between a carrying position wherein said handle is generally coplanar with said sections in the folded carrier configuration of said accessory, and an accessory support position wherein said handle forms a part of said accessory supporting means and projections below said latter section for engagement with a supporting surface in said unfolded cradle configuration of said accessory and said supporting means further comprises means for releasibly securing said handle in its support position.

8. An infant care accessory according to claim 7 wherein:

said support wall of each section has water drain holes.

9. An infant care accessory according to claim 8 wherein:

said supporting means further comprise suction cups mounted on the support wall of said other section for adherence to the supporting surface in said cradle configuration of said accessory.

10. An infant care accessory according to claim 9 wherein:

said accessory is shaped to simulate a turtle.

* * * * *